US010758029B1

(12) United States Patent
Grismer

(10) Patent No.: US 10,758,029 B1
(45) Date of Patent: Sep. 1, 2020

(54) BACKPACK WITH TWO ATTACHED HOODS

(71) Applicant: Bryan Grismer, San Diego, CA (US)

(72) Inventor: Bryan Grismer, San Diego, CA (US)

( * ) Notice: Subject to any disclaimer, the term of this patent is extended or adjusted under 35 U.S.C. 154(b) by 0 days.

(21) Appl. No.: 16/414,206

(22) Filed: May 16, 2019

(51) Int. Cl.
*A45F 3/04* (2006.01)
*A45F 4/12* (2006.01)

(52) U.S. Cl.
CPC . *A45F 3/04* (2013.01); *A45F 4/12* (2013.01)

(58) Field of Classification Search
CPC ..... A45F 3/04; A45F 2003/003; A45F 3/001; A45F 4/12; A45F 4/02; A41D 12/04; A41D 2200/20; A42B 1/048
See application file for complete search history.

(56) References Cited

U.S. PATENT DOCUMENTS 4,389,735 A * 6/1983 McLaughlin ..... A41D 15/04 2/94
4,563,777 A * 1/1986 Park ..... A41D 15/04 2/108
5,165,111 A * 11/1992 Lieberman ..... A41D 15/04 2/108
D339,912 S * 10/1993 Delauter ..... D2/866
5,407,112 A * 4/1995 Christodoulou ..... A41D 15/04 2/94
5,676,293 A * 10/1997 Farris ..... A45F 3/04 2/175.7
6,843,398 B2 * 1/2005 Zion ..... A45F 3/08 224/155
6,874,162 B2 * 4/2005 Boezi ..... A41D 3/00 2/84
9,125,477 B2 * 9/2015 Killion ..... A45F 4/12
D781,532 S * 3/2017 Kelly ..... D2/866
2007/0118960 A1 * 5/2007 Goodwin ..... A41D 1/04 2/84
2010/0078457 A1 * 4/2010 Pitchford ..... A42B 1/048 224/576
2017/0112265 A1 * 4/2017 Vance, III ..... A42B 1/041
2019/0059562 A1 * 2/2019 Escava ..... A45F 3/04

* cited by examiner

*Primary Examiner* — Corey N Skurdal
(74) *Attorney, Agent, or Firm* — Ezra Sutton

(57) ABSTRACT

A backpack is provided with multiple attached hoods, comprising a front wall, a back wall, a first inner compartment for carrying items, and a second outer compartment having a pocket opening. The first and second hoods are attached to an attachment strip that is itself attached to the front wall of the backpack, but is spaced apart from the wall for creating a passage to the second outer compartment. At least one or both of the first and second hoods can pass through the passage to enter a pocket opening in the second outer compartment and may be selectively stored in the outer compartment independently of each other.

11 Claims, 9 Drawing Sheets

BACKPACK WITH TWO ATTACHED HOODS

FIELD OF THE INVENTION

The present invention relates to a backpack with multiple attached hoods that can be selectively and independently used as desired.

BACKGROUND OF THE INVENTION

Traditionally backpacks have been known and widely used for their increased carrying capacity and ability to provide ready access to needed gear or items while also providing protection of the gear and items from collision, abrasion, dust, and theft, as well as from the elements and weather conditions such as rain and snow. However, recently, backpacks have become very popular not only for their utility, but also as fashion accessories. Moreover, a backpack can now also function as a fashion accessory that may be selected and worn simply for the purposes of fashion style instead of or in addition to its aforementioned utilitarian functions.

Likewise, garments with attached single hoods, including hooded sweatshirts, commonly referred to as "hoodies," have also been traditionally known and worn for their utility in protecting a wearer's head and face from sun, wind, rain, snow, cold and other outside elements and forces. However, similar to backpacks, hooded garments have also become fashionable in recent years. Depending on the wearer's personal style, the wearer can select whether to wear the hood up, covering the head, or down, generally hanging at an upper area of the back of the garment. In addition, hooded garments also reflect a wearer's personal style and fashion trends since the hoods of these garments are often decorated with decorative logos or indicia on them.

More recently, many designers have sought to combine the utilitarian and fashionable aspects of both backpacks and hooded garments by creating and marketing backpacks with integral single hoods. Some of these backpacks feature compartments or pockets for storing a single hood. However, backpacks having integral single hoods have utilitarian, as well as stylistic limitations. More specifically, when a single hood is attached to a backpack, the wearer is limited to the fabric limitations of the single hood. For instance, if the single hood is only comprised of non-water proof or non-water resistant fabrics, the hood will not keep the users head dry in the event of rain or snow. Likewise, if the hood is only comprised of heavy, non-breathable fabrics, the hood will not keep the users cool when traveling to a warm climate. Similarly, with backpacks featuring an attached single hood, the wearer is limited to wearing a single hood having only one color or decorative theme, indicia, or logo(s).

Accordingly, there is a need for a backpack with multiple attached hoods wherein each of the hoods can be worn separately and independently, and wherein each of the multiple hoods can be comprised of different fabrics, as well as feature different indicia or decorations so as to better adapt to the wearers' fashion, style, and utilitarian demands.

DESCRIPTION OF THE PRIOR ART

Numerous prior art patents disclose backpacks having an integral hood that can be removably stored within a compartment or pocket within the backpack. For instance, the following design patents disclose the ornamental designs for the combination of a backpack with a single hood: (a) U.S. Design Pat. No. D339,912 to Keith H. Delauter entitled "Combined Backpack and Hood" which issued on Oct. 5, 1993 discloses the ornamental design for a combined backpack and a single hood wherein the hood is removably stored in a pocket in the backpack; and (b) U.S. Design Pat. No. D781,532 to Edward Kelly entitled "Hood for a Backpack" which issued on Mar. 21, 2017 discloses the ornamental design for a single hood for a backpack that removably folds into a zippered pocket.

Likewise, the following utility patents disclose the structural combination of a backpack with a single hood: (a) US Patent Publication No. 2010/0078457 to Scott Pitchford, et al. entitled "Hooded Backpack and Speaker Combination Device and Method Therefor" which published on Apr. 1, 2010 discloses a backpack with a single hood attached to the backpack that can be into a compartment on the top of the backpack. (b) U.S. Pat. No. 4,389,735 to Rita E. McLaughlin entitled "Convertible Article" which issued on Jan. 28, 1983 discloses a coat with a single hood that can be folded into a separate compartment of the backpack; (c) U.S. Pat. No. 4,563,777 to Park entitled "Combination Cargo Pack" which issued on Jan. 14, 1986 discloses a cargo pack wherein the front panel of the pack provides a flap closure for removably storing a garment with a single hood; (d)

U.S. Pat. No. 5,165,111 to Richard A. Lieberman entitled "Backpack with Integral Garment" which issued on Nov. 24, 1992 discloses a backpack having an integral garment with a single hood wherein the integral garment may be withdrawn from storage compartment within the backpack; (e) U.S. Pat. No. 5,407,112 to Thomas N. Christodoulou, et al. entitled "Convertible Backpack" which issued on Apr. 18, 1995 discloses a convertible backpack having a storage compartment for a single hooded raincoat in the front of the pack; (f) U.S. Pat. No. 5,676,293 to Beverly W. Farris entitled "Backpack and Method of Using Same" which issued on Oct. 14, 1997 discloses a backpack with a hood attached to the upper portion of the pack by a strap; (g) U.S. Pat. No. 6,843,398 to Isaac Zion entitled "Rucksack" which issued on Jan. 18, 2005 discloses a knapsack or rucksack with an integral single cap or hood that can be stored within a pocket on the top portion of the sack; and (h) U.S. Pat. No. 9,125,477 to Bernard J. Killion entitled "Backpack Hood Strap" discloses a backpack with an integral attached single hood which may be stored within a pocket or storage compartment of the shoulder straps of the backpack.

Also, the following two prior art utility references disclose a sweatshirt and a jacket each having multiple hoods respectively. For example, U.S. Patent Publication No. 2007/0118960 to Tymond B. Goodwin entitled "Hoody Hood Sweatshirt," which was published on May 31, 2007 discloses a sweatshirt made with two hoods, one in the back and the other in the front wherein the two hoods are connected by a single stitch. Also, U.S. Pat. No. 6,874,162 to Valentino T. Boezi entitled "Reversible Jacket Having Multiple Hoods" was issued on Apr. 5, 2005 and discloses a reversible jacket that includes two independently functional flexible hoods that allow a person wearing the jacket to utilize one hood in one configuration of the jacket, and the other hood in a reversed configuration. Both hoods are stored within the same pocket on the back of the jacket.

However, none of the aforementioned prior art references teach or disclose the basic structure of a backpack with two or multiple hoods that are integrally attached to the backpack and that can be selectively and independently stored in a pocket or compartment of the backpack.

OBJECTS OF THE INVENTION

It is an object of the present invention to provide a backpack with attached multiple hoods that allows the wearer to selectively choose which hood to wear.

Another object of the invention is to provide a backpack with attached multiple hoods wherein the attached hoods are each attached to an attachment strip on the front wall of the backpack which permits each hood to be either worn or folded into a pocket independently of the other one.

Another object of the present invention is to provide a backpack with attached multiple hoods wherein each attached hood can be made of different fabrics or materials for combating different weather conditions and different climates.

Another object of the present invention is to provide a backpack with attached multiple hoods that combines the portability and carrying capacity of a backpack and the protection and decorative and fashion aspects of a hood.

Another object of the present invention is to provide a backpack with attached multiple hoods wherein one or both of the hoods contains a fabric liner.

A further object of the present invention is to provide a backpack with attached multiple hoods wherein each attached hood can feature different design indicia.

SUMMARY OF THE INVENTION

A backpack is provided with multiple attached hoods having a first inner compartment for carrying items, a second outer compartment having a pocket opening, and an attachment strip attached to the front wall of the backpack, but spaced apart from the front wall for creating a passage to the pocket opening of the second outer compartment. The backpack has a first hood and a second hood, which are nestable, and they are both attached to the attachment strip. One or both of the first and second hoods may be selectively stored in the second outer compartment by passing the hoods through the passage to enter the pocket opening of the second outer compartment.

DETAILED DESCRIPTION OF THE PREFERRED EMBODIMENT

Figure 1:
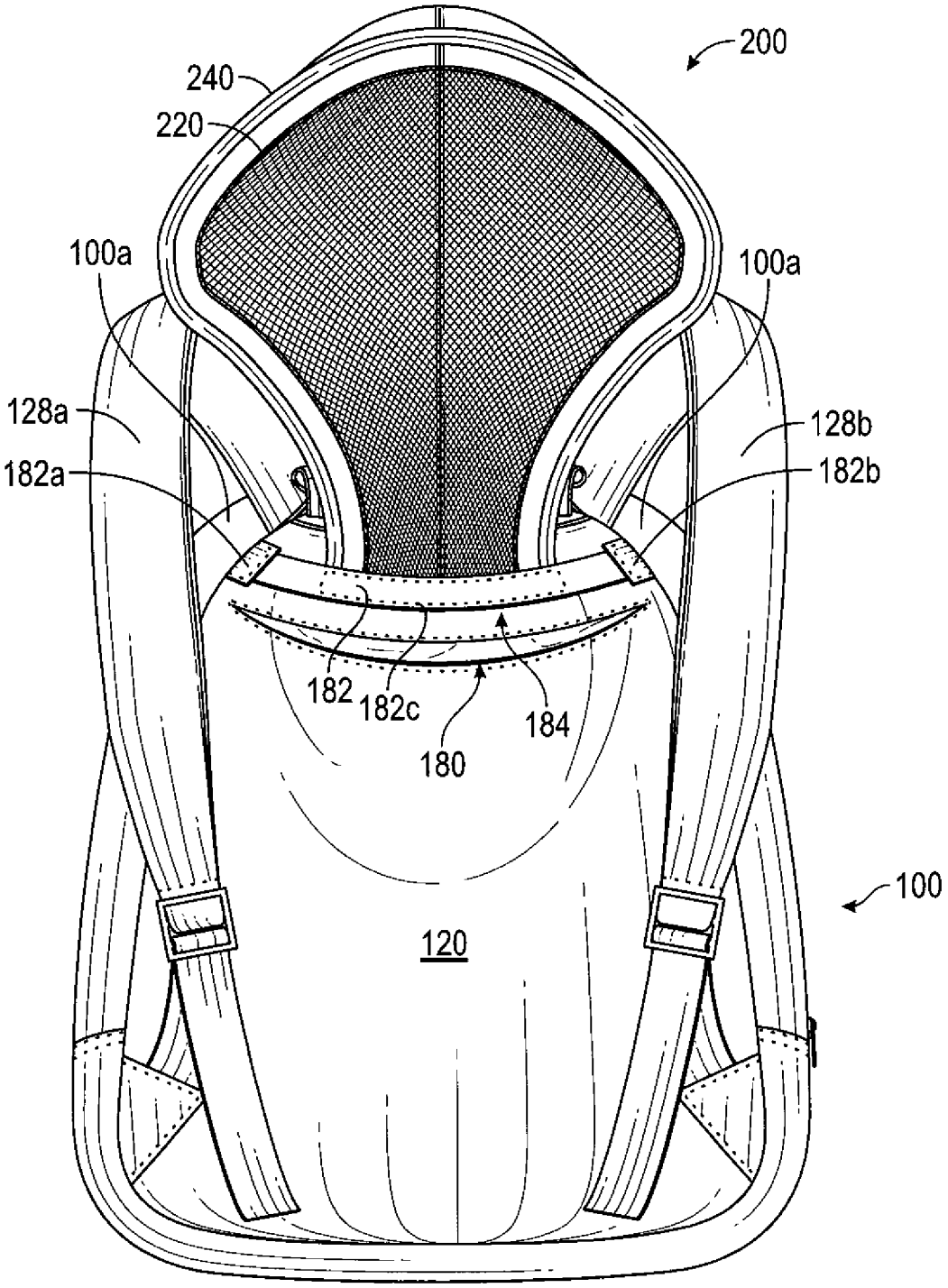
FIG. 1 is a front view of the first embodiment of the front wall of the backpack, the front view of the two attached hoods, the attachment strip, and the outer pocket compartment for storing the hoods of the present invention.
Figure 2:
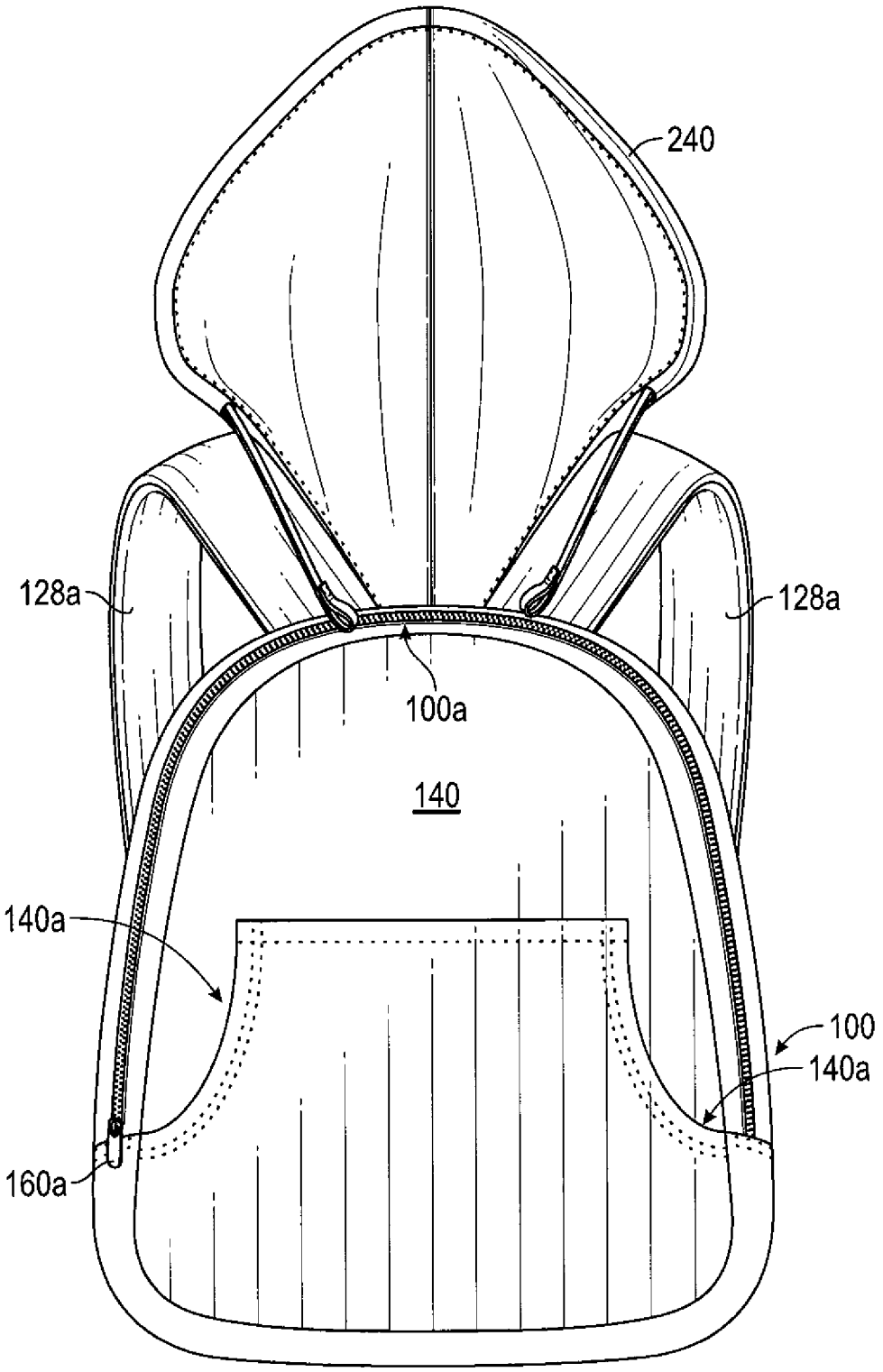
FIG. 2 is a rear view thereof of the backpack showing the back wall, the back pocket, and the back of the hoods.
Figure 3:
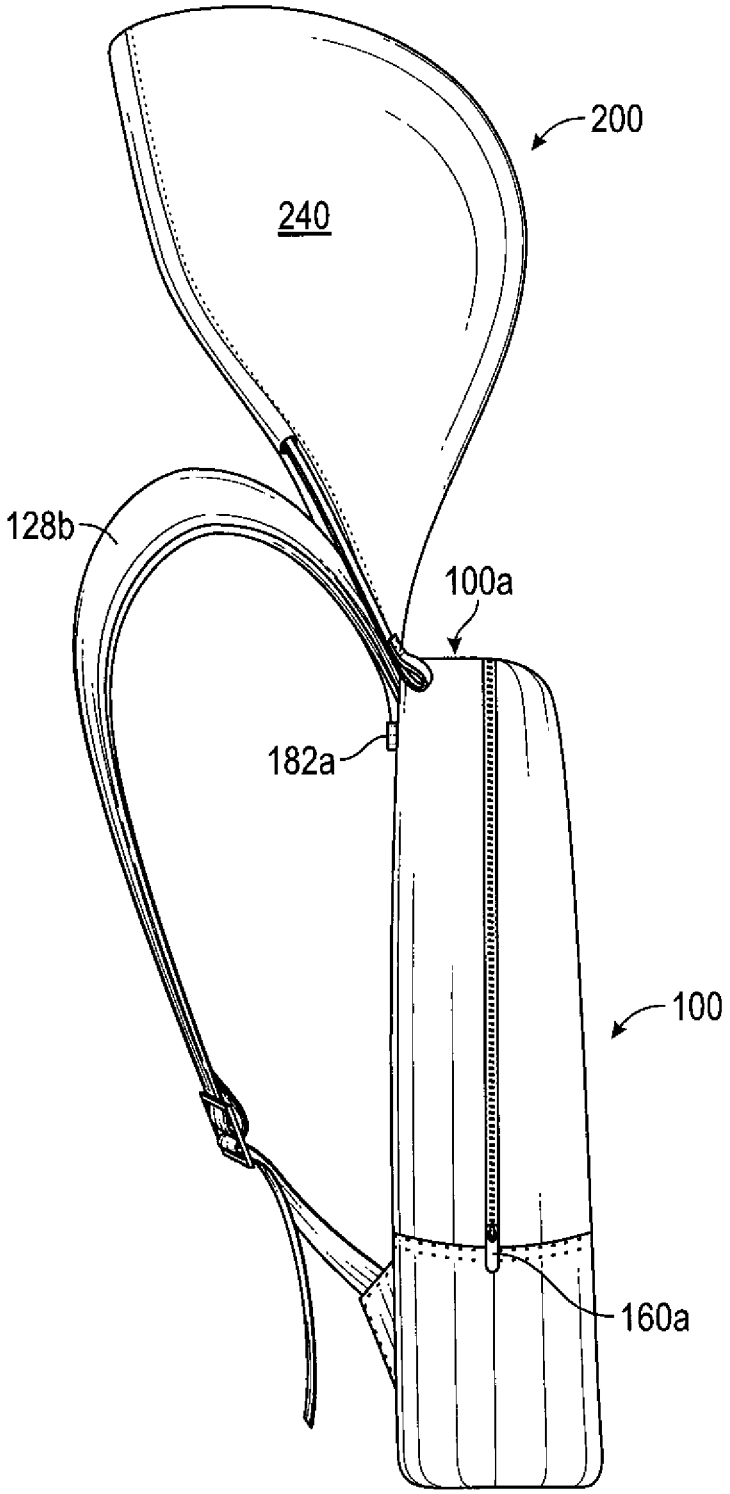
FIG. 3 is a right side view thereof of the backpack, the attached hoods, the attachment strap, and the shoulder straps.
Figure 4:
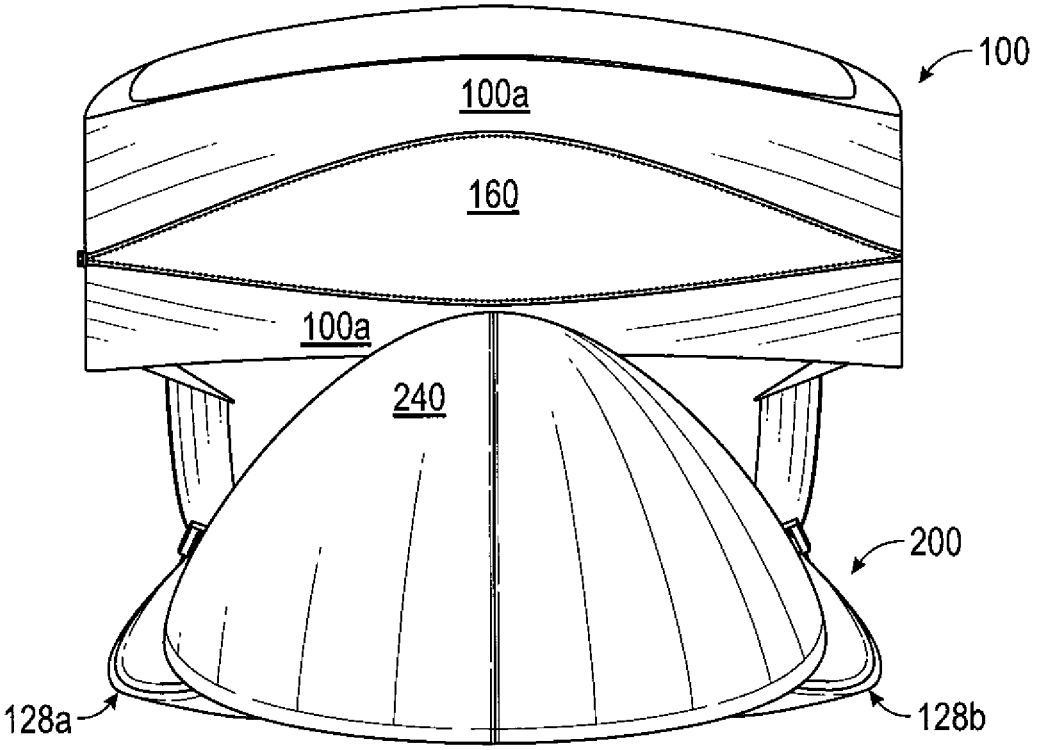
FIG. 4 is a top view thereof showing the inner compartment in an open position and showing the top of the back second hood.
Figure 5:
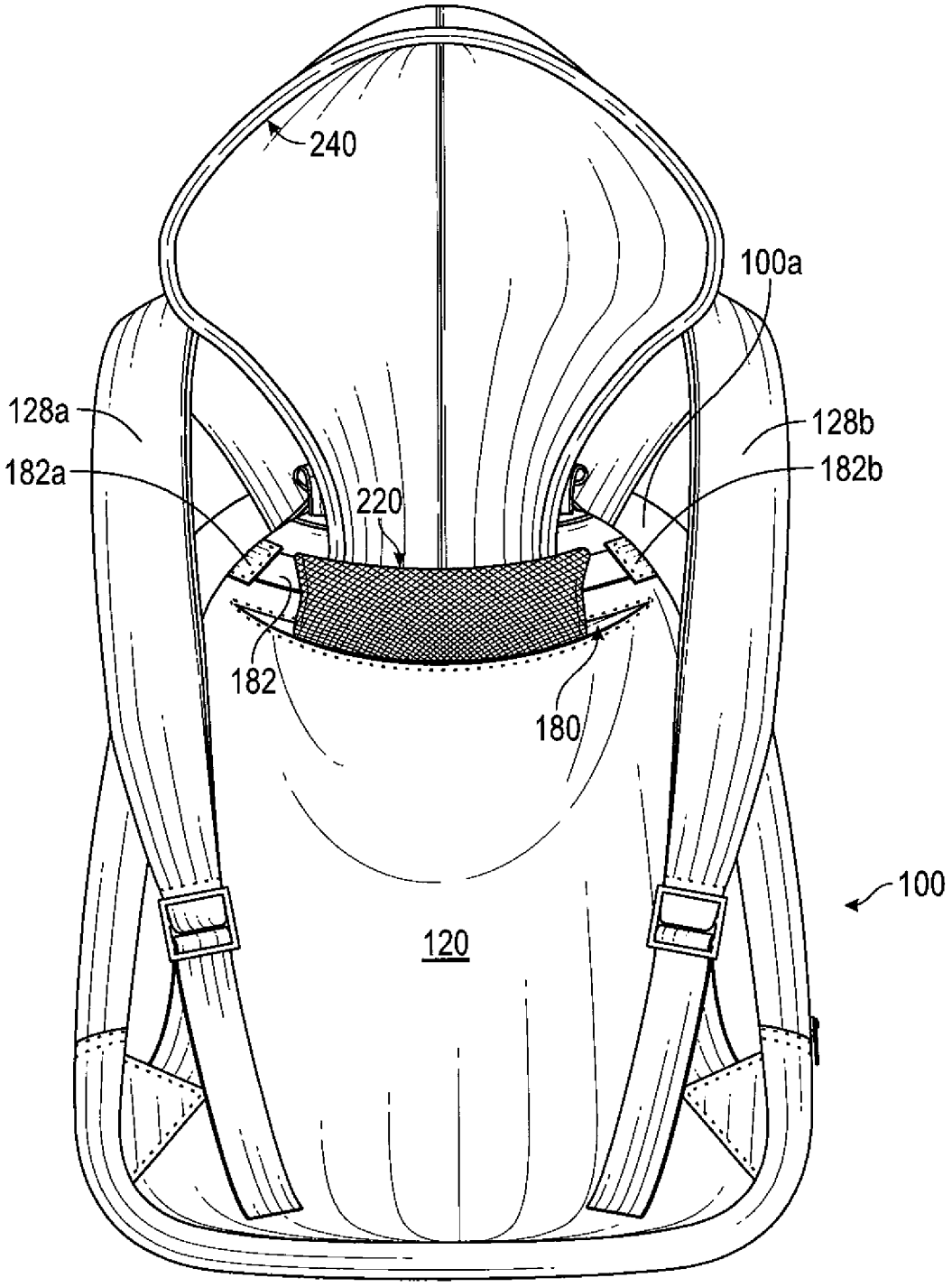
FIG. 5 is a front view thereof showing the first front hood being folded over the attachment strip and tucked into the outer pocket compartment.
Figure 6:
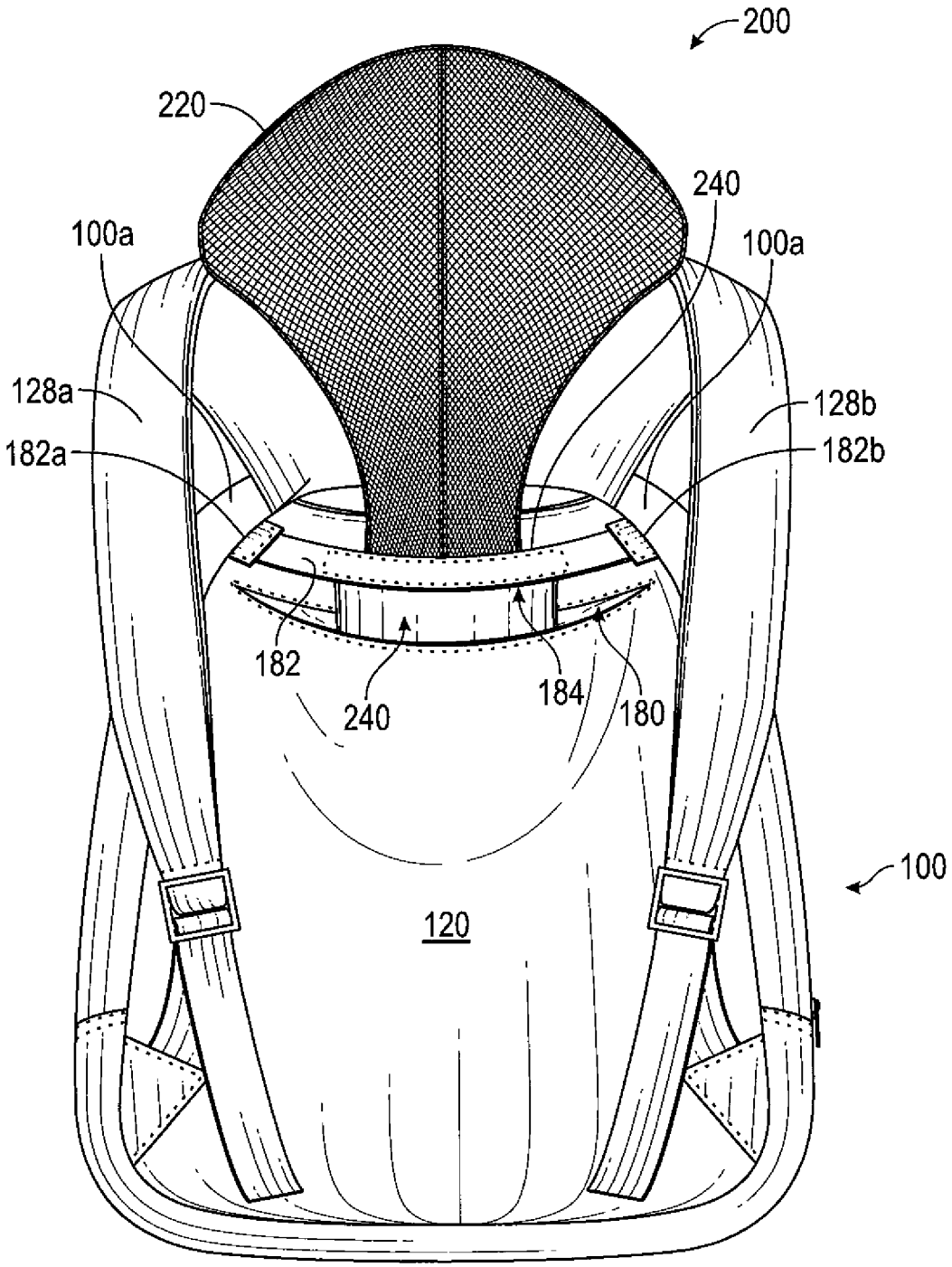
FIG. 6 is a front view thereof showing the second back hood being folded under the attachment strip and tucked into the outer pocket compartment.
Figure 7:
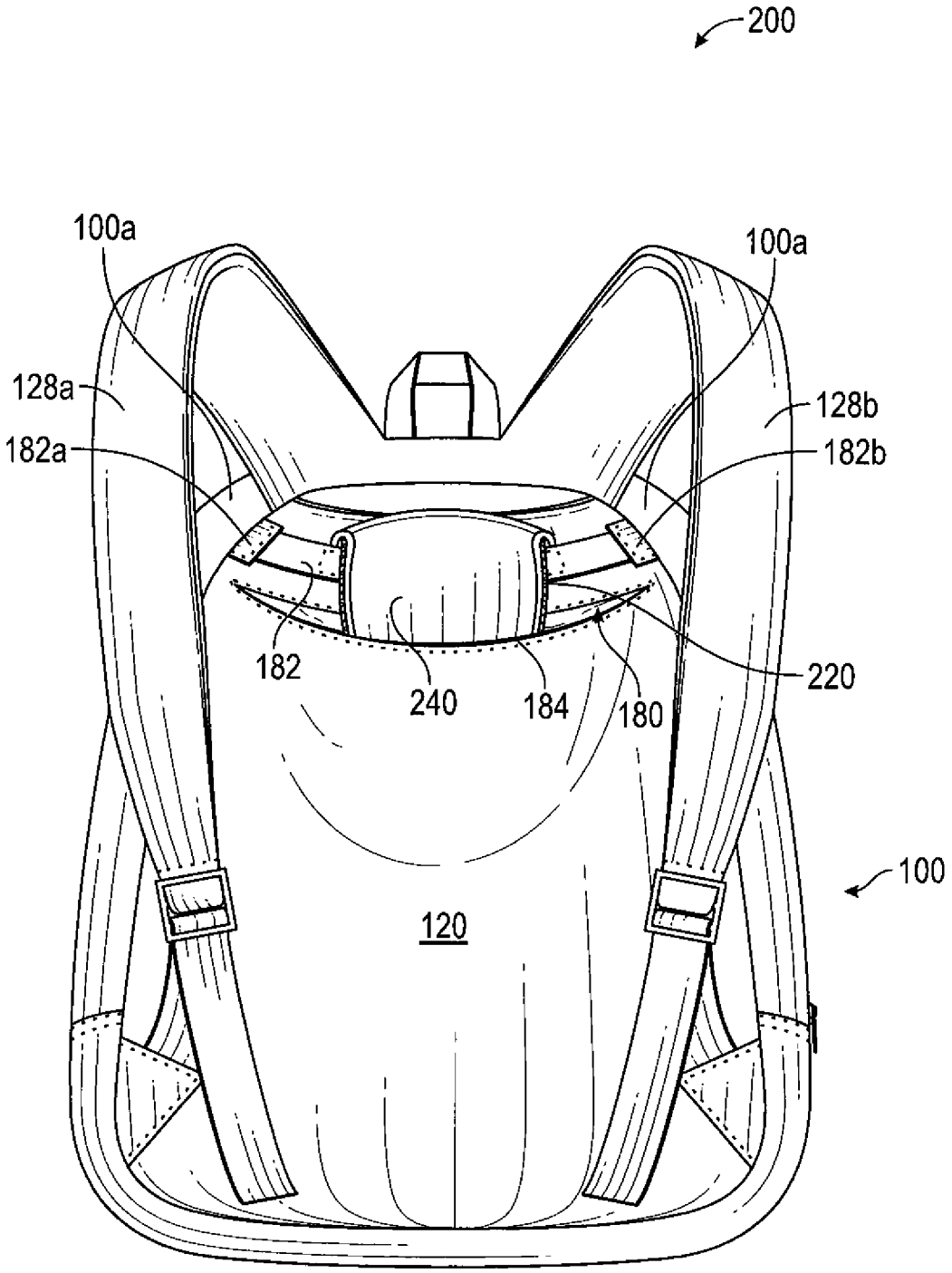
FIG. 7 is a front view thereof showing the first front hood and second back hood being both folded over the attachment strip and tucked into the outer pocket compartment.
Figure 8:
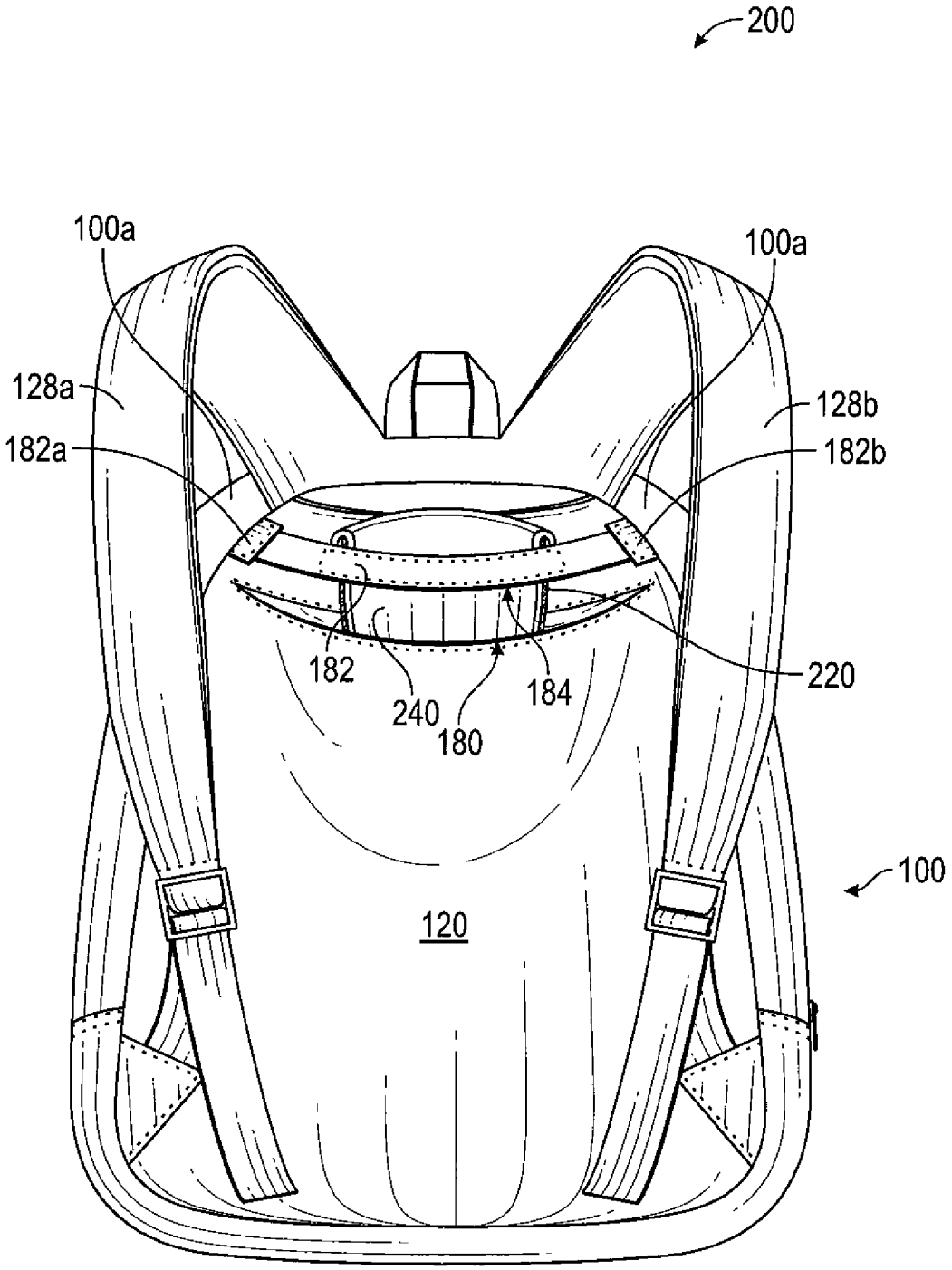
FIG. 8 is a front view thereof showing the first front hood and second back hood being both folded under the attachment strip and tucked into the outer pocket compartment.
Figure 9:
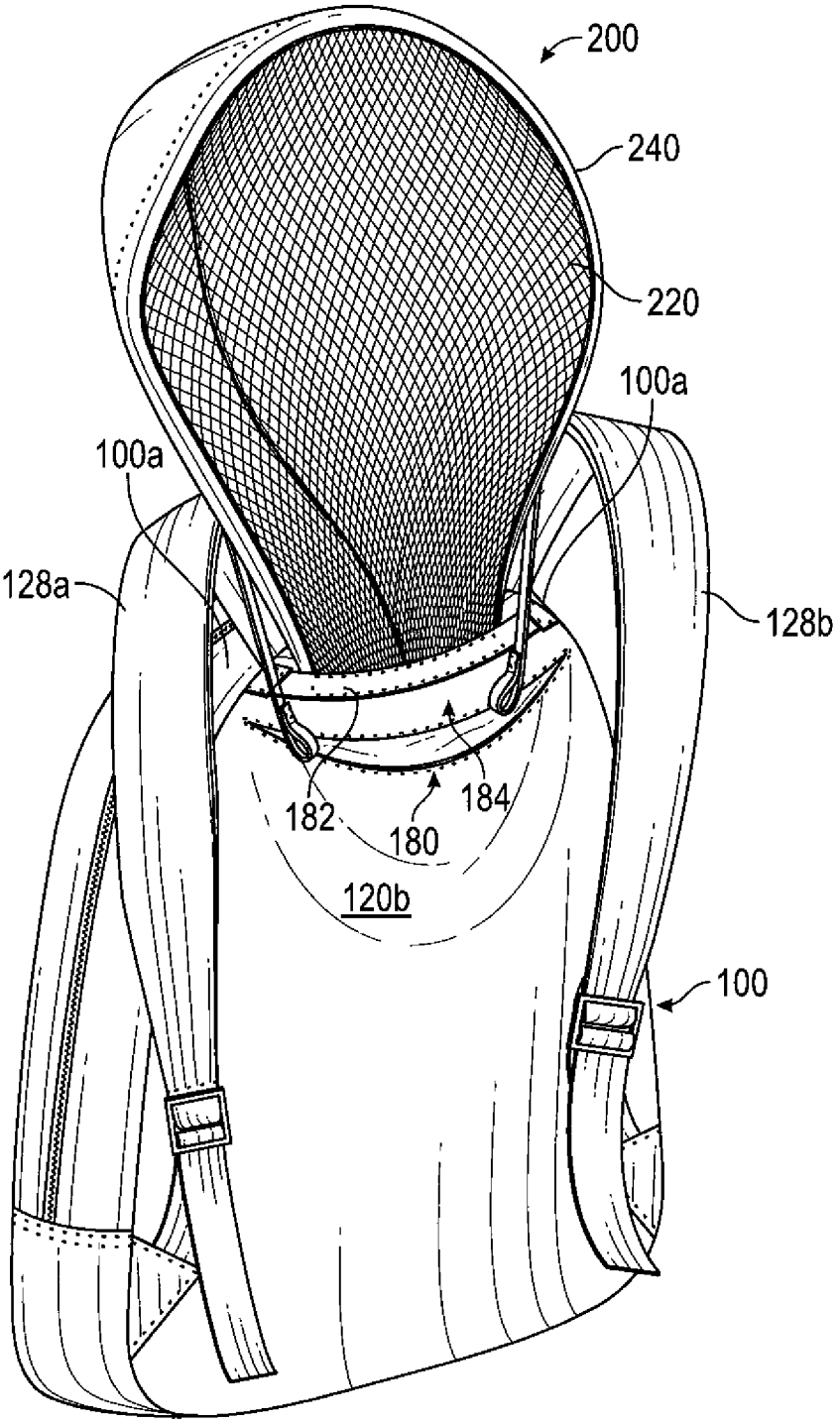
FIG. 9 is a perspective view of the backpack of the present invention.

The present invention provides a backpack 100 with multiple attached hoods 200, composed of natural or synthetic fabric, plastic, or leather or combinations thereof. Specifically, the backpack and hood may be constructed from materials selected from a group comprising: poplin, fleece, polar fleece, tricot, plated jersey, French terry, wool, velour, cotton terry, poly mesh, leather, nylon, cashmere, denim, twill, corduroy, synthetic leather, waterproof materials, or other non-waterproof materials. The backpack 100 further includes a front wall 120, a back wall 140, a first inner compartment 160 for carrying items, a second outer compartment 180 having a pocket 181, and an attachment strip 182. The attachment strip 182 is attached to the front wall 120 at attachment points 182*a* and 182*b*, but spaced apart from wall 120 for creating a passage 184 to the pocket 181 of second outer compartment 180. Additionally, the front wall 120 of the outer compartment 180 has shoulder straps 128*a* and 128*b* that are each attached to the top section 100*a* of the backpack. In addition, the back wall 140 can optionally have one or more pockets 140*a* for storing items.

Preferably, the first inner compartment 160 of the backpack 100 has a closure device 160*a* for securing items in the first inner compartment 160. The closure device 160*a* extends along the top and both sides of the inner compartment 160 and it can be a zipper, a hook and loop fastener, buttons and button holes, snaps, a tongue and groove fastener, overlapping flaps, or a combination thereof.

The backpack 100 also has an attached first front hood 220 and an attached second back hood 240. The first and second hoods 220, 240 are both attached along a single common seam to the attachment strip 182. Also, the first front hood 220 is nestable with the second back hood 240. Because the bottom edges of the first front hood 220 and the second back hood 240 are attached by stitch lines 182*c* to the attachment strip 182, and are not directly attached to the backpack, the first and second hoods 220, 224 are each constructed to pass through the passage 184. Also, each hood can be selectively and independently stored in the outer compartment 180.

Thus, pursuant to this construction, the wearer can choose to either wear both the first and the second hoods 220, 240 together with the first hood 220 nested into the second hood 240, or the wearer can choose to wear either the first hood 220 or the second hood 240 by themselves independently of the other. In addition, either or both of the first or the second hoods 220, 240 may each contain a hood liner 260 comprised of a separate material attached to the inside of the hood 210.

In addition, at least one or both of the first and second hoods 220, 240 can be folded or stuffed and thereby stored into the outer compartment 180. Preferably, the outer compartment 180 has a center front wall 180*a* wherein a pocket is formed thereon for storing one or both of the first and second hoods 220, 240 inside. In accordance with this construction, when the wearer of the backpack 100 chooses to wear only the first attached hood 220, the wearer can optionally let the second attached hood 240 hang over the back wall 140 of the backpack 100 or optionally the wearer can pass the second attached hood 240 through the passage 184 and into the pocket of the second outer compartment 180. Also, in accordance with this construction, when the wearer of the backpack 100 chooses to wear only the second attached hood 240, the wearer can optionally let the first attached hood 220 hang over the back wall 140 of the backpack 100 or optionally the wearer can pass the first attached hood 220 through the passage 184 and into the pocket of the second outer compartment 180. However, when the wearer of the backpack 100 does not choose to wear the first and second hoods 220, 240, the wearer can either optionally let both hoods 220, 240 hang over the back wall 140 of the backpack 100, or optionally the wearer can insert the first and/or the second attached hoods 220, 240 through the passage 184 and into the pocket 181 of the second outer compartment 180.

Like the backpack, the attached first and second hoods 220 and 240 and hood liner(s) 260 can be composed of natural or synthetic fabric, plastic, or leather or combinations thereof. Specifically, the materials for constructing the first and second hoods, and the hood liner(s) may be selected from a group comprising: poplin, fleece, polar fleece, tricot, plated jersey, French terry, wool, velour, cotton terry, poly mesh, leather, nylon, cashmere, denim, twill, corduroy, synthetic leather, waterproof materials, or other non-waterproof materials. However, the first and second hoods 220 and 240, and the hood liner(s) 260 can each be comprised of different materials. Also, at least one or both of the first and second hoods 220 and 240 can have design indicia on them.

The term "backpack" as used throughout this specification should be taken to include all forms of backpacks, bookbags, packs, haversacks, knapsacks, rucksacks, and bags with shoulder straps generally.

In the specification the terms "comprise, comprises, comprised and comprising" or any variation thereof and the terms "include, includes, included and including" or any variation thereof are considered to be totally interchangeable and they should all be afforded the widest possible interpretation.

ADVANTAGES OF THE PRESENT INVENTION

It is an advantage of the present invention to provide a backpack with attached multiple hoods that allows the wearer to selectively choose which hood to wear.

Another advantage of the invention is to provide a backpack with attached multiple hoods wherein the attached hoods are each attached to an attachment strip on the front wall of the backpack which permits each hood to be either worn or folded into a pocket independently of the other one.

Another advantage of the present invention is to provide a backpack with attached multiple hoods wherein each attached hood can be made of different fabrics or materials for combating different weather conditions and different climates.

Another advantage of the present invention is to provide a backpack with attached multiple hoods that combines the portability and carrying capacity of a backpack and the protection and decorative and fashion aspects of a hood.

Another advantage of the present invention is to provide a backpack with attached multiple hoods wherein one or both of the hoods contains a fabric liner.

A further advantage of the present invention is to provide a backpack with attached multiple hoods wherein each attached hood can feature different design indicia.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A backpack with multiple attached hoods, comprising:

(a) a front wall, a back wall, a first inner compartment for carrying items, a second outer compartment having a pocket opening, a top section, and an attachment strip attached to said front wall creating a passage to said pocket opening of said second outer compartment, said passage formed between said attachment strip and said front wall;

(b) said backpack having a first hood and a second hood, wherein said first and said second hoods are both attached to said attachment strip; and (c) wherein at least one or both of said first and second hoods are selectively stored in said second outer compartment, and wherein either of said first or second hoods pass through said passage to enter said pocket opening of said second outer compartment.

2. A backpack with multiple attached hoods, in accordance with claim 1, wherein said second outer compartment further having a center front wall, wherein said wall forms said pocket opening for receiving one or both of said first and second hoods.

3. A backpack with multiple attached hoods, in accordance with claim 2, wherein said front wall of said second outer compartment further having shoulder straps.

4. A backpack with multiple attached hoods, in accordance with claim 1, wherein said first inner compartment of said backpack has a closure device for securing said items in said first inner compartment, wherein said closure device is selected from the group comprising a zipper, hook and loop fasteners, buttons and button holes, snaps, tongue and groove fastener, overlapping flaps, and combinations thereof.

5. A backpack with multiple attached hoods, in accordance with claim 4, wherein said closure device extends along a top and both sides of said inner compartment of said backpack.

6. A backpack with multiple attached hoods, in accordance with claim 1, wherein said first and second hoods are nestable.

7. A backpack with multiple attached hoods, in accordance with claim 1, wherein either or both of said first or said second hoods contain a hood liner.

8. A backpack with multiple attached hoods, in accordance with claim 7, wherein said backpack, said first and second hoods, and said hood liner are made of material selected from the group comprising poplin, fleece, polar fleece, tricot, plated jersey, French terry, wool, velour, cotton terry, poly mesh, leather, nylon, cashmere, denim, twill, corduroy, synthetic leather, waterproof materials, and other non-waterproof materials.

9. A backpack with multiple attached hoods, in accordance with claim 8, wherein said backpack, said first and second hoods, and said hood liner are each comprised of different materials.

10. A backpack with multiple attached hoods, in accordance with claim 1, wherein at least one or both of said first and second hoods having design indicia thereon.

11. A backpack with multiple attached hoods, in accordance with claim 1, wherein said back wall has a pocket for storing items.

* * * * *